US010233608B2

(12) United States Patent
Tuell

(10) Patent No.: US 10,233,608 B2
(45) Date of Patent: Mar. 19, 2019

(54) SEALING SYSTEM FOR PRECAST CONCRETE STRUCTURES

(71) Applicant: Gulf Coast Underground, LLC, Theodore, AL (US)

(72) Inventor: Spencer A. Tuell, Mobile, AL (US)

(73) Assignee: Gulf Coast Underground, LLC, Theodore, AL (US)

( * ) Notice: Subject to any disclaimer, the term of this patent is extended or adjusted under 35 U.S.C. 154(b) by 0 days.

(21) Appl. No.: 15/858,796

(22) Filed: Dec. 29, 2017

(65) Prior Publication Data

US 2018/0187390 A1 Jul. 5, 2018

Related U.S. Application Data

(60) Provisional application No. 62/440,652, filed on Dec. 30, 2016.

(51) Int. Cl.

| | |
|---|---|
| ***E02D 29/12*** | (2006.01) |
| ***E02D 29/14*** | (2006.01) |
| ***B65D 90/10*** | (2006.01) |
| ***E03F 5/02*** | (2006.01) |

(52) U.S. Cl.

CPC ..... *E02D 29/14* (2013.01); *B65D 90/10* (2013.01); *E02D 29/128* (2013.01); *E03F 5/021* (2013.01)

(58) Field of Classification Search

CPC ..... E02D 29/14; E02D 29/128; E02D 29/121; B65D 90/10; B65D 90/08; E03F 5/021; E03F 2005/028

See application file for complete search history.

(56) References Cited

U.S. PATENT DOCUMENTS

| | | | | |
|---|---|---|---|---|
| 3,891,224 | A * | 6/1975 | Ditcher | E02D 29/149 277/605 |
| 4,187,647 | A | 2/1980 | Hall | |
| 5,030,033 | A * | 7/1991 | Heintzelman | B65D 88/76 220/88.3 |
| 5,201,600 | A | 4/1993 | Topf, Jr. et al. | |
| 5,431,553 | A | 7/1995 | Topf, Jr. | |
| 5,536,457 | A | 7/1996 | Topf, Jr. | |
| 7,828,496 | B1 * | 11/2010 | Martin | F16L 13/113 277/608 |
| 9,499,716 | B2 | 11/2016 | Laurence | |
| 2013/0121763 | A1 | 5/2013 | Phillips et al. | |
| 2016/0108601 | A1 | 4/2016 | Strand | |

* cited by examiner

*Primary Examiner* — Patrick J Maestri

(74) *Attorney, Agent, or Firm* — Nelson Mullins Riley & Scarborough LLP

(57) ABSTRACT

A sealing system for sealing a joint of a structure, including a first section having an inner wall, an outer wall and a contact surface extending therebetween, a second section having an inner surface, an outer surface and a contact extending therebetween, the contact surfaces of the first and second sections being in contact with each other, thereby forming a joint. A void is defined by a portion of the contact surface of the first section and a portion of the contact surface of the second section, a port extends from one of the inner surface and the outer surface of the first section to the annular void, and liquid grout disposed in the void and the port.

6 Claims, 2 Drawing Sheets

SEALING SYSTEM FOR PRECAST CONCRETE STRUCTURES

CLAIM OF PRIORITY

This application claims priority to U.S. Provisional Patent Application No. 62/440,652, filed Dec. 30, 2016, the entire disclosure of which is incorporated by reference herein.

FIELD OF INVENTION

The presently disclosed invention relates generally to pre-cast structures and, more particularly, to systems and methods for preventing leakage from occurring at joints formed between precast sections of structures.

BACKGROUND

Sewer manholes and lift station wet wells are typically constructed with precast concrete sections. Due to the installation location and uses for the manholes and lift station wet wells, the joints formed between precast sections have the potential for leakage to occur.

Currently, the primary method to combat leakage at the wall joints is to simply lay a gasket 10 between the precast sections 12 and 14 at the joints when the sections are stacked, as shown in FIG. 1. Hydraulic cement may also be packed around the joint on the inner and outer surfaces of the structure in hopes that the cement will stop any leaks that make it past the gasket 10. Over time, the hydraulic cement often cracks and spalls off the wall and/or the gasket material squeezes out of the joint and becomes ineffective at stopping leaks. A common fix for this type of issue in older structures is to drill into the wall joint at an angle and inject hydrophilic or hydrophobic urethanes, depending on the flow rate at the leak. These leaks are often a problem from day one and not just after years of being installed.

There remains a need, therefore, for sealing systems that are suitable for use in preventing potential leakage between precast concrete structures.

SUMMARY OF THE INVENTION

One embodiment of the present invention provides a sealing system for sealing a joint of a structure, including a first section of the structure including an inner surface, an outer surface and a contact surface extending therebetween. A second section of the structure includes an inner surface, an outer surface and a contact surface extending therebetween, the contact surface of the second section being in contact with the contact surface of the first section, thereby forming a joint. A void is defined by a portion of the contact surface of the first section and a portion of the contact surface of the second section, a port extends from one of the inner surface and the outer surface of the first section to the void, and liquid grout disposed in the void and the port.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

The invention now will be described more fully hereinafter with reference to the accompanying drawings, in which some, but not, all embodiments of the invention are shown. Indeed, this invention may be embodied in many different forms and should not be construed as limited to the embodiments set forth herein; rather, these embodiments are provided so that this disclosure will satisfy applicable legal requirements.

Figure 1:
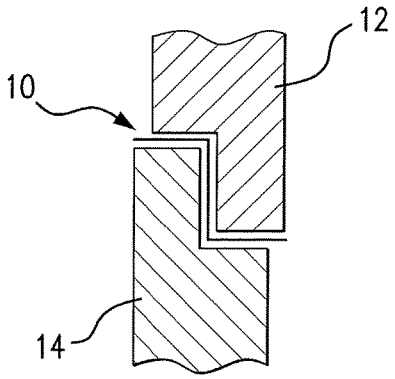
FIG. 1 is a partial cross-sectional view of a prior art sealing system for joints formed between precast sections of a structure.

Repeat use of reference characters in the present specification and drawings is intended to represent same or analogous features or elements of the invention according to the disclosure.

DETAILED DESCRIPTION

The invention now will be described more fully hereinafter with reference to the accompanying drawings, in which some, but not, all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Figure 2:
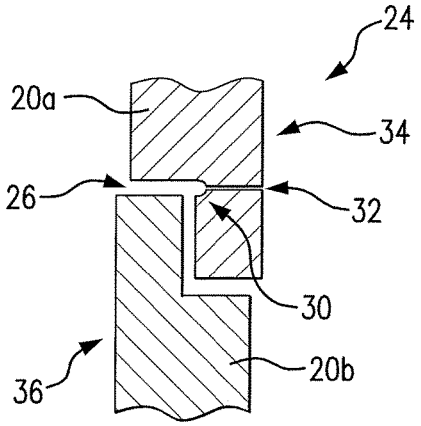
FIG. 2 is a partial, exploded cross-sectional view of a sealing system for joints formed between precast sections of a structure in accordance with an embodiment of the present invention.
Figure 3:
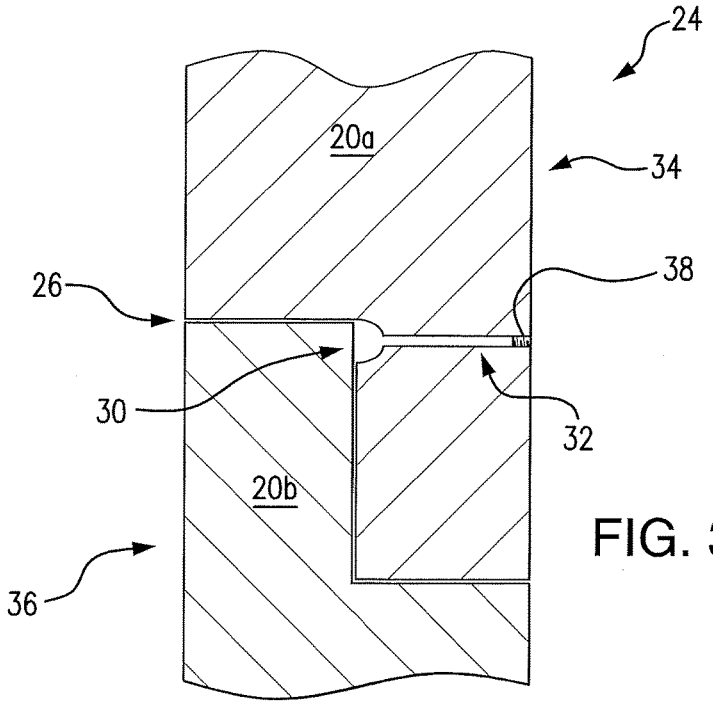
FIG. 3 is a partial cross-sectional view of the sealing system shown in FIG. 2.
Figure 4:
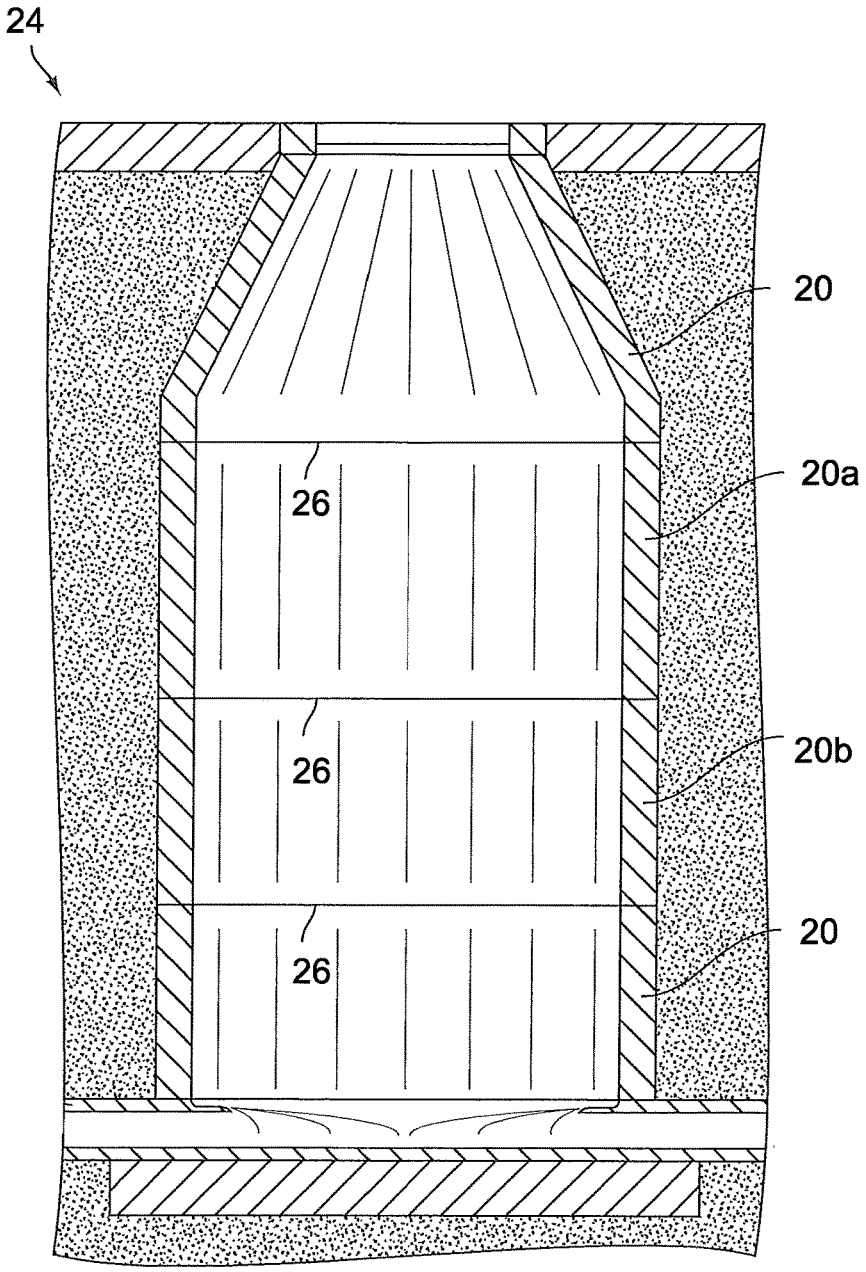
FIG. 4 is a cross-sectional view of a sewer manhole formed of precast sections having the sealing system shown in FIGS. 2 and 3 at the joints between the precast sections.

In accordance with the present invention, as shown in FIGS. 2 through 4, a first section 20*a* and a second section 20*b* of a concrete structure such as, but not limited to, a sewer manhole 24 (FIG. 4), a lift station wet well, cylindrical structures, etc., form a joint 26 therebetween. Preferably, both first section 20*a* and second section 20*b* are concrete structures that are precast in corresponding form molds. As shown, the form mold creates a void 30 that is disposed between first and second sections 20*a* and 20*b*. As well, at the time of pouring wet concrete into the form, there will also be at least one location where an internally threaded port 32 is formed through the wall.

Each internally threaded port 32 extends radially outwardly from an inner surface 34 of the concrete structure 24, in the parent case a sewer manhole (FIG. 4), to void 30. Note, however, in alternate embodiments, threaded ports 32 may extend radially inwardly from an outer surface 36 of the concrete structure 24 to a corresponding void. As well, in the preferred embodiment, void 30 is formed by a continuous, annular groove so that the injected chemical grout, as discussed below, is free to flow about the circumference of joint 26 between the precast structures. However, in alternate embodiments, multiple voids can be formed, each one having a corresponding pre-formed port 30 in fluid communication therewith.

Once cured, and the molds are removed, the precast first section 20*a* has a pre-formed port 32 that provides a pathway from the inside surface 34 of the structure, such as a manhole wall, back to void 30 between the two sections. Following field installation of the precast sections, port 32 is used to inject chemical grout into the corresponding pre-formed void 30. The chemical grout travels the circumference of void 30 along joint 26. Where larger diameter structures are in use, multiple port 32 locations may be utilized to ensure that the chemical grout travels around the entire circumference of the structure. The chemical grout swells upon contact with water to fill void 30 and squeeze out between the precast sections to fill any cracks or pathways that may contribute to leakage. An example chemical grout is Avanti AV-100, manufactured by Avanti International, Houston, Tex. Once void 30 is filled with chemical grout, ports are sealed using suitably threaded caps 38 to help ensure the joint is watertight.

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

What is claimed:

1. A sealing system for sealing a joint of a structure, comprising:

a first section of the structure including an inner surface, an outer surface and a contact surface extending therebetween about a perimeter of the first section;

a second section of the structure including an inner surface, an outer surface and a contact surface extending therebetween about the perimeter of the first section, the contact surface of the second section being in contact with the contact surface of the first section along their entire perimeters, thereby forming a continuous joint;

a void defined by a portion of the contact surface of the first section and a portion of the contact surface of the second section;

a port extending from an opening formed on one of the inner surface and the outer surface of the first section to the void, the opening of the port being displaced from the joint formed by the contact surfaces of the first and second sections, and liquid grout disposed in the void and the port.

2. The sealing system for claim 1 wherein the first section and the second section of the structure are both cylindrical.

3. The sealing system for claim 2, wherein the portion of the contact surface of the first section that defines the void is an annular groove.

4. The sealing system for claim 3, further comprising a plurality of ports extending from the one of the inner surface and the outer surface of the first section to the annular groove.

5. The sealing system for claim 2, wherein the first and the section sections are portions of one of a sewer manhole and a lift station wet well.

6. A method of sealing a joint between a first section and a second section of a structure, comprising the steps of:

precasting the first section of the structure so that the first section has an inner surface, an outer surface, a contact surface extending therebetween about a perimeter of the first section;

precasting the second section of the structure so that the second section has an inner surface, and outer surface and a contact surface extending therebetween about a perimeter of the second section, and an annular groove defined by the contact surface;

placing the contact surfaces of the first and the second sections together along their entire perimeters so that a continuous joint is formed therebetween and the annular groove defines a void;

injecting liquid grout into the annular void; and forming a port in the first section, the port extending from an opening formed in one of the inner surface and the outer surface of the first section to the annular groove, wherein the opening of the port is displaced from the joint.

* * * * *